US007854708B2

(12) United States Patent
Tong et al.

(10) Patent No.: US 7,854,708 B2
(45) Date of Patent: Dec. 21, 2010

(54) MULTIPLE JOINT LINKAGE DEVICE

(76) Inventors: Kai Yu Tong, The Hong Kong Polytechnic University, Hunghom, Kowloon (HK); Rong Song, The Hong Kong Polytechnic University, Hunghom, Kowloon (HK); Chiu Hoi Lam, The Hong Kong Polytechnic University, Hung Hom, Kowloon (HK); Wai Man Tam, The Hong Kong Polytechnic University, Hung Hom, Kowloon (HK); Kwok Kuen Kwong, The Hong Kong Polytechnic University, Hung Hom, Kowloon (HK); Tak Chi Lee, The Hong Kong Polytechnic University, Hung Hom, Kowloon (HK); Man Kit Peter Pang, The Hong Kong Polytechnic University, Hung Hom, Kowloon (HK); King Lun Kwok, The Hong Kong Polytechnic University, Hung Hom, Kowloon (HK); Mau Wah Chan, The Hong Kong Polytechnic University, Hung Hom, Kowloon (HK); Woon Fong Wallace Leung, The Hong Kong Polytechnic University, Hung Hom, Kowloon (HK)

( * ) Notice: Subject to any disclaimer, the term of this patent is extended or adjusted under 35 U.S.C. 154(b) by 882 days.

(21) Appl. No.: 11/802,273

(22) Filed: May 22, 2007

(65) Prior Publication Data

US 2008/0293551 A1 Nov. 27, 2008

(51) Int. Cl.
*A61H 1/02* (2006.01)

(52) U.S. Cl. ..... 601/5; 601/33

(58) Field of Classification Search ..... 601/5, 601/27, 31, 32, 33–36, 40; 482/44–46
See application file for complete search history.

(56) References Cited

U.S. PATENT DOCUMENTS

| | | | | |
|---|---|---|---|---|
| 4,030,141 | A | | 6/1977 | Graupe |
| 4,936,299 | A | | 6/1990 | Erlandson |
| 5,466,213 | A | | 11/1995 | Hogan et al. |
| 5,645,073 | A | | 7/1997 | Kadefors et al. |
| 5,679,004 | A | | 10/1997 | McGowan et al. |
| 5,738,636 | A | * | 4/1998 | Saringer et al. ..... 601/5 |
| 5,755,645 | A | | 5/1998 | Miller et al. |
| 5,830,160 | A | | 11/1998 | Reinkensmeyer |
| 5,848,979 | A | * | 12/1998 | Bonutti et al. ..... 601/5 |
| 6,062,754 | A | * | 5/2000 | Holdren ..... 401/48 |
| 6,379,393 | B1 | | 4/2002 | Mavroidis et al. |
| 6,500,094 | B1 | | 12/2002 | Lin |
| 6,613,000 | B1 | | 9/2003 | Reinkensmeyer et al. |
| 6,859,663 | B2 | | 2/2005 | Kajitani et al. |
| 6,878,122 | B2 | | 4/2005 | Cordo |
| 6,966,882 | B2 | | 11/2005 | Horst |
| 2006/0106326 | A1 | | 5/2006 | Krebs et al. |

* cited by examiner

*Primary Examiner*—Loan Thanh
*Assistant Examiner*—Valerie Skorupa
(74) *Attorney, Agent, or Firm*—The Hong Kong Polytechnic University

(57) ABSTRACT

The present invention relates to devices and methods for a joint linkage device suitable for training multi-joints in a single limb. The joint linkage device is capable of rotation at a proximal end and a distal end. The device includes a proximal end having an upper plate, a middle plate, and a lower plate, a distal plate, a side bar, a main bar, a switch mechanism, and an extended bar. In use, a torque from a motor is applied to the upper plate to provide a user with an assistance torque, a resistance torque, or a assistance/resistance torque.

17 Claims, 9 Drawing Sheets

MULTIPLE JOINT LINKAGE DEVICE

BACKGROUND

Massive trauma to a body, such as a stroke, head injury, or spinal cord injury, and even old age, can cause a person's motor skills in multiple muscle groups to be impaired and the person often losses the full range of motion in the limbs. Usually, such affected people under various forms of therapy attempt to regain the full range motion. In the present day, therapy machines are often utilized to retrain various limbs in movement.

However, the affected person often have more than one muscle group impaired, or on one limb, there may be several joints incapable of satisfactory movement following trauma. In such circumstances, when a therapy machine is used, multiple add-on modules are required in order to train different joints on one limb. For example, one module may be required for elbow joint rotation thus training the infraspinals and teres minor. Another module may be required for wrist joint rotation, thus training the supraspinals. The use of more than one module requires "switching out" or removing one module from a machine and replacing it with another. "Switching out" is time consuming, and if the impaired person is training alone, is almost impossible.

It is an object of the present invention to present devices and method to allow the training of multiple joints on a limb using one training module, and over the disadvantages of the prior art.

DESCRIPTION

The present invention proposes a joint linkage device capable of training more than one joint in a limb.

The present invention also proposes methods for multi-joint training in a single limb using a module of the present invention.

The present invention further proposes training more than one joint in a single limb by using a module containing distal and proximal plates, connected by bars capable of rotation, whereby both plates may rotate during alternate modes.

The present invention still further proposes devices and methods described herein to aid impaired persons and trainers from having to use more than one training module when training a limb.

These and other features, aspects, and advantages of the apparatus and methods of the present invention will become better understood from the following description, appended claims, and accompanying drawings where:

Figure 11:
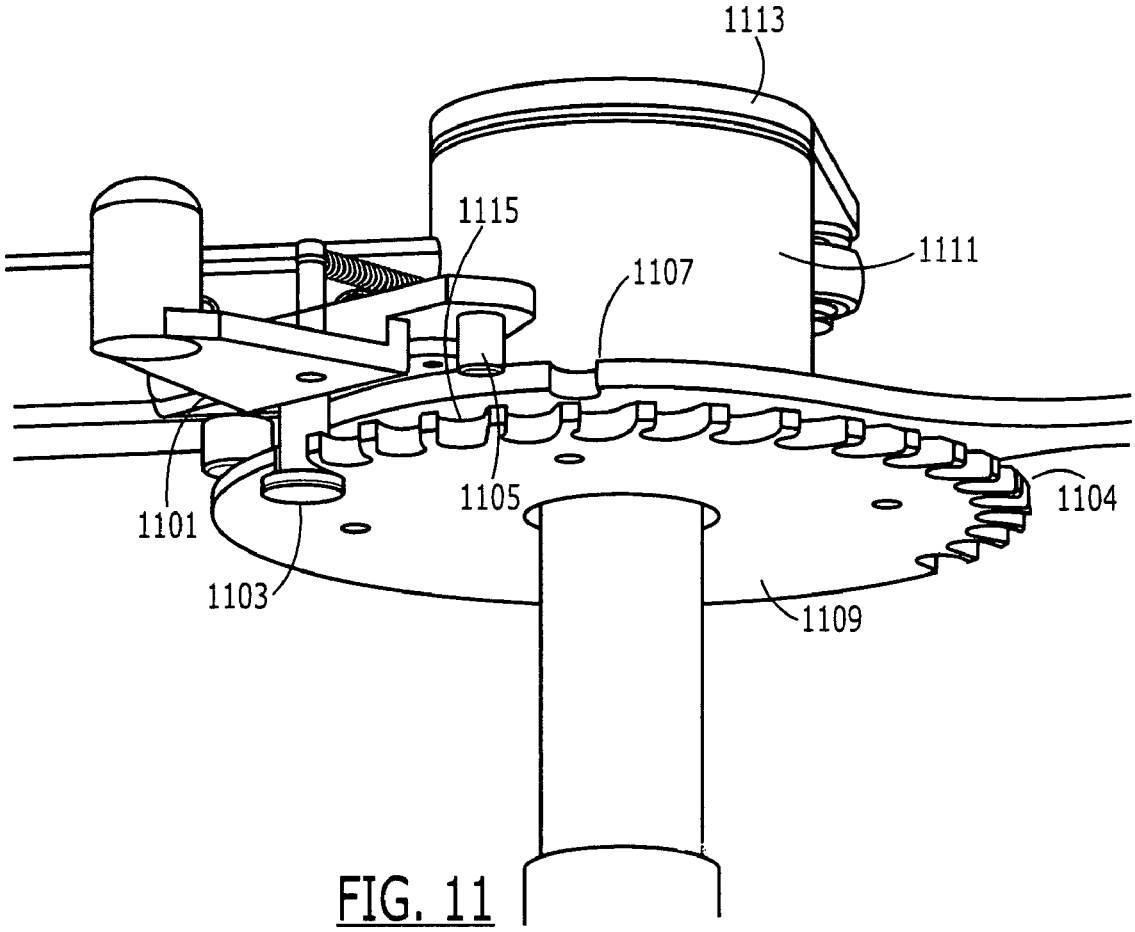

FIG. 11 provides a view of the switch mechanism and plates of the device.

Figure 12:
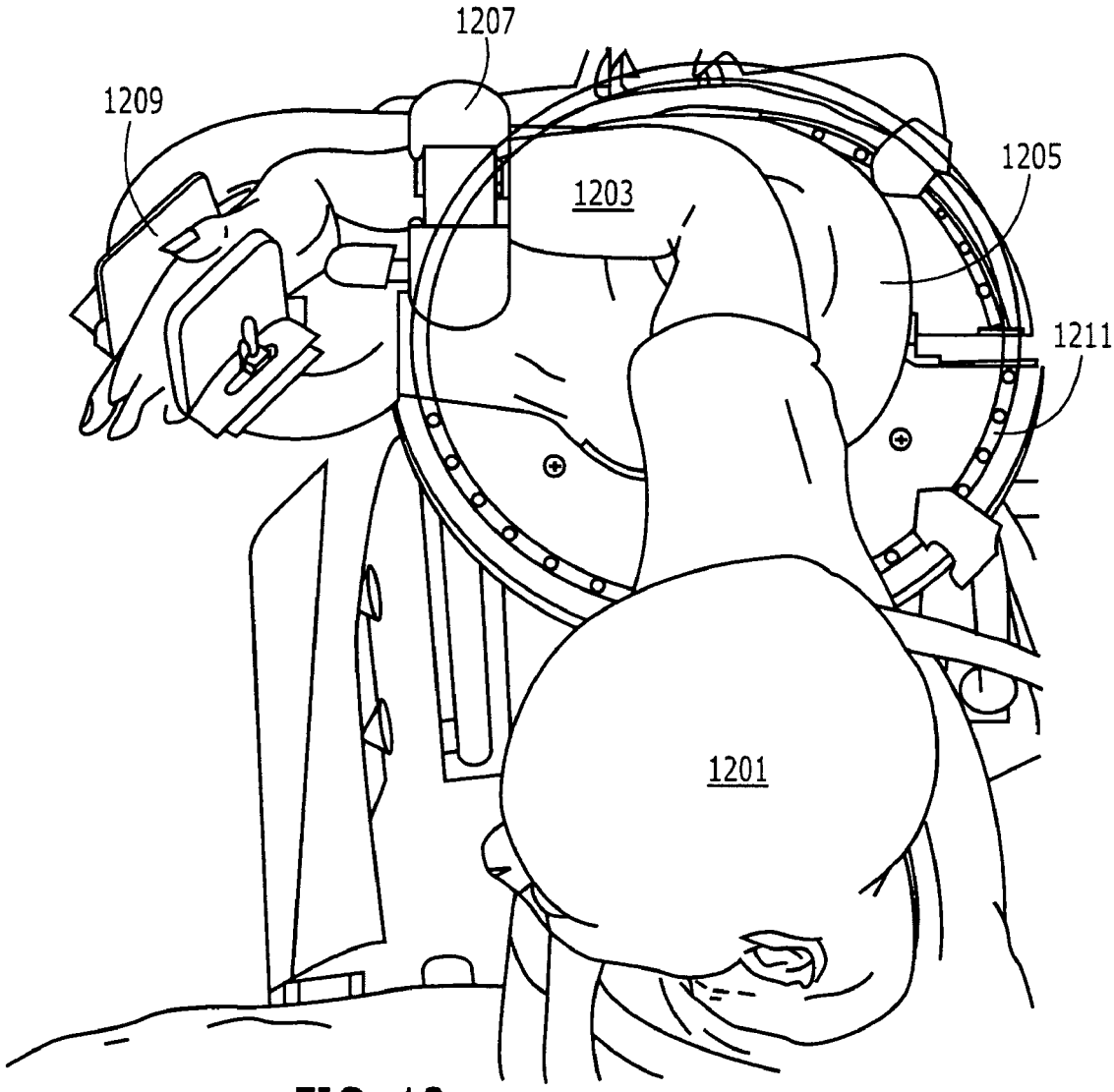

FIG. 12 exhibits the user interacting with the device.

The following description of certain exemplary embodiment(s) is merely exemplary in nature and is in no way intended to limit the invention, its application, or uses. Throughout this description, the term "user" refers to human patients requiring neuro-muscular rehabilitation. The term "electronically operable" refers to systems generally employing micro-processors, resistors, capacitors, inductors, and sensors for extracting information from mechanical inputs and outputs via electrical activators to mechanical systems. The term "rotatably positioned" refers to a component capable of movement in the x, y, and/or z plane while being connected to another component.

Now, to FIGS. 1-12, which, while presented individually, in total teach the present invention.

The present invention relates to a device and methods for rotating multiple joints of a limb using one joint linkage device. Through the device, users do not need to utilize more than one device when exercising multiple joints on a limb. The present invention improves upon prior art method of requiring multiple devices by using a newly developed linkage system to transfer the rotation axis from a proximal to a distal location, and vice versa. The device is suitable for being mounted on training or exercise equipment. In one embodiment, the device is mounted on a robotic system.

Figure 1:
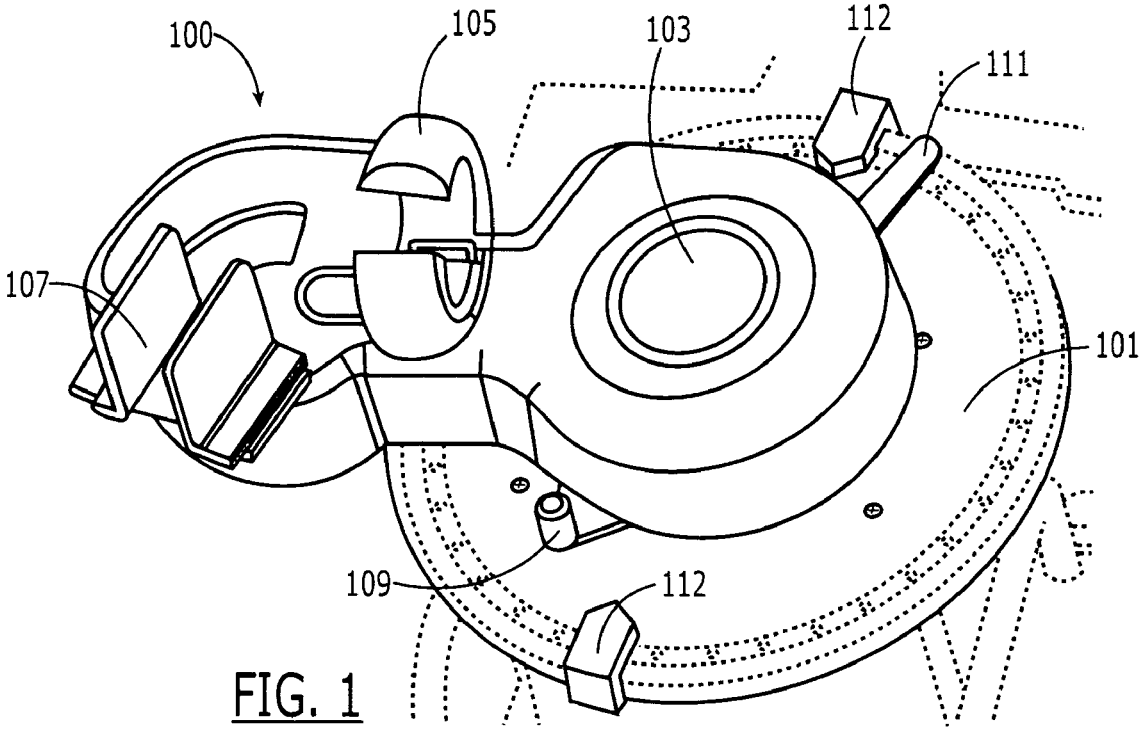
FIG. 1 is an embodiment of the joint linkage device of the present invention.

FIG. 1 shows an embodiment of the joint linkage device 100 of the present invention. The joint linkage device 100 includes an elbow rest 103, an arm cuff 105, a hand clasp 107, a switch mechanism 109, and an extended bar 111. As shown, the device 100 is designed for being mounted on or attached to a surface 101, for example a nautilus machine, a robotic system, and the like.

The elbow rest 103 is suitable for accepting an elbow of a user. The rest 103 can be made of a supple material to allow comfort when resting the elbow. The diameter of the rest 103 can be such that it can accommodate elbows of different sizes.

The arm cuff 105 is suitable for holding the forearm (and limb, in general) in place within the device. While the embodiment 100 shows the cuff 105 to be bracelet-like, different style arm cuffs may be used while not deviating from the invention, for example Velcro straps, square-shaped cuffs, etc. The cuff 105 should have an expandable means, such as a movable joint, for accommodating forearms of different sizes. As will be discussed later, the cuff 105 can be positioned along different areas of the device 100 to allow maximum comfort for the user.

A hand clasp 107 is used to maintain the limb in a particular position, as well as being instrumental in exercising the wrist joint. In use, the clasp 107 accommodates a hand between two plates, and then the plates are closed in until the hand is firmly held. The plates of the clasp 107 may be manually operated or electronically operable. In manual operation, the plates are moved together, and then secured into position with a screw-type means.

In being electronically operable, the plates are closed together in response to an electronic signal; a sensor can be used to indicate when enclosing should stop because the hand is firmly held. The clasp 107 should be covered with a material to make it suitable for skin contact, for example cotton, polyester, silk, padding, and the like.

A switch mechanism 109 is included for switching between joints during training. As will be discussed later, the switch mechanism 109 actuates a pawl for insertion into a particular ratchet. The switch mechanism 109 may be manually operated or electronically operable. For manual operation, the switch mechanism 209 preferably possesses a knob or handle for actuation. In being electronically operable, the switch mechanism 209 may be wired or wirelessly connected to controller for receiving an electric signal. The switch mechanism 109 is preferably in a joint, allowing the mechanism 109 one translational degree of freedom.

The overall movement (rotation) of the device 100 is range limited by an extended bar 111 and stoppage blocks 112 positioned on the surface 101. The blocks 112 can be positioned to provide a range of movement from 10° to 270° along the surface circumference. The blocks 112 are can be made of a scratch resistant material, such as rubber or another polymer, or a metal.

Figure 2:
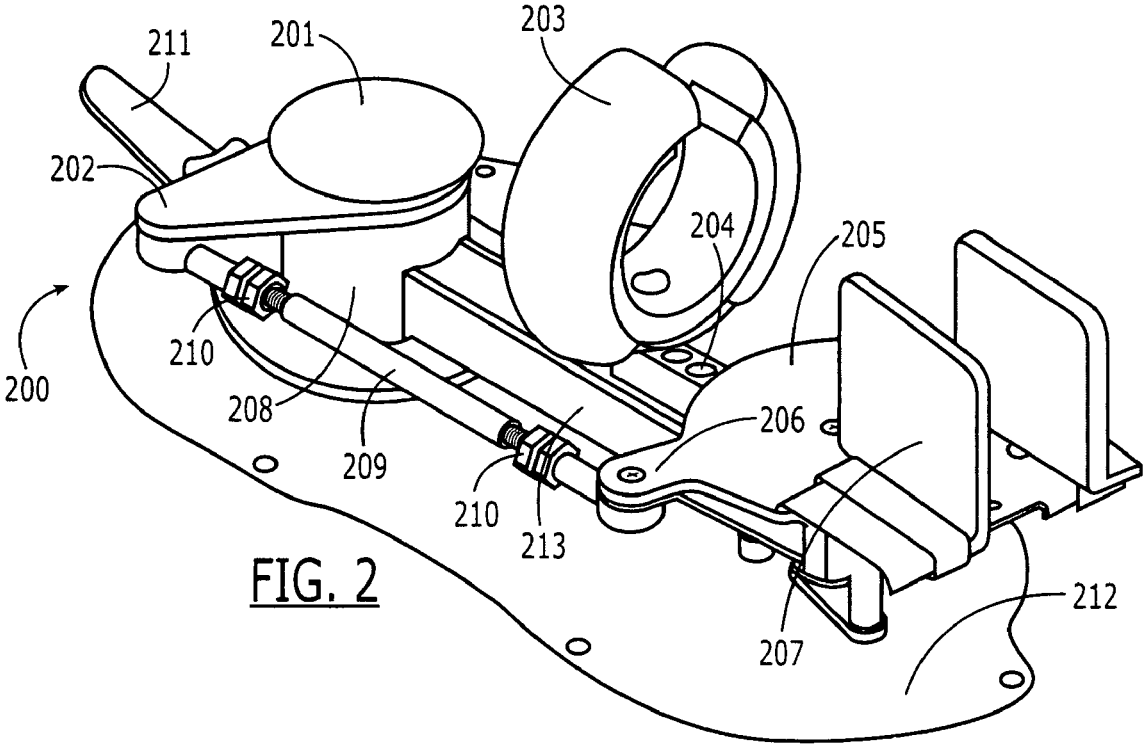
FIG. 2 is an embodiment of the internal components of the joint linkage device.

FIG. 2 is an embodiment of the internal components of the joint linkage device 200. The internal components include but are not limited to, upper plate 201, distal plate 205, main bar 213, and side bar 209.

The upper plate 201 serves a torque deliverer, capable of transmitting a torque from a motor to the distal plate 205. The upper plate 201 preferably possesses an extended portion 202 for connecting with the side bar 209 and a base for connecting to the device's chassis 212. As will be discussed later, the side bar 209, while connected to the extended portion 202, is allowed rotation. The upper plate 201 also provides the underlying support to a user's elbow. The upper plate 201 sits on a middle plate 208.

As stated previously, a side bar 209 is one means of attachment between the upper plate 201 and the distal plate 205. The side bar 209 can be made of a metal, such as stainless steel, or a polymer such as a hard plastic. The side bar 209 can have a male end for connecting to a female end, such female end being the extended portion of the upper plate 201 and the distal plate 205. In a preferred embodiment, the side bar 209 possesses helical grooves or thread-formed ends on either side for fastening a nut 210 attached to the plates 201/205. In such an embodiment, the operation of the device 200, namely the transmitting of torque from the upper plate 201 to the distal plate 205, can be enhanced or minimized by the screwing or unscrewing the side bar 209 from either nut 210.

The distal plate 205 is suitable for providing underlying support for a distal portion of a user's limb. The distal plate 205 preferably includes an extended portion 206 for connecting to the side bar 209 and a base (not shown) for attachment to the chassis 212. The distal plate 205 contains means for accepting the hand clasp 207, such as adaptor holes (not shown).

The upper plate 201 and the distal plate 205 are principally connected by a rotatably positioned main bar 213. The main bar 213 also provides support for the device 200, and acts as a support for the limb's middle section, such as forearm. The main bar 213 further includes positioning means 204, such as holes, allowing the arm cuff 203 to be adjusted. As will be discussed later, the main bar 213 possesses components allowing it to be rotated during operation of the device 200.

As stated earlier, the device may be manually or electronically operable. In being manually operable, adjustments such as the side bar 209, or the position of the arm cuff 203, can be made by a user or operator physically interacting with the device 200. In being electronically operable, adjustments can be made via a controller wired or wirelessly connected to the device 200. In such an embodiment, the device should contain electronic components including but not limited to resistors, capacitors, and inductors, as is known in the art.

Figure 3:
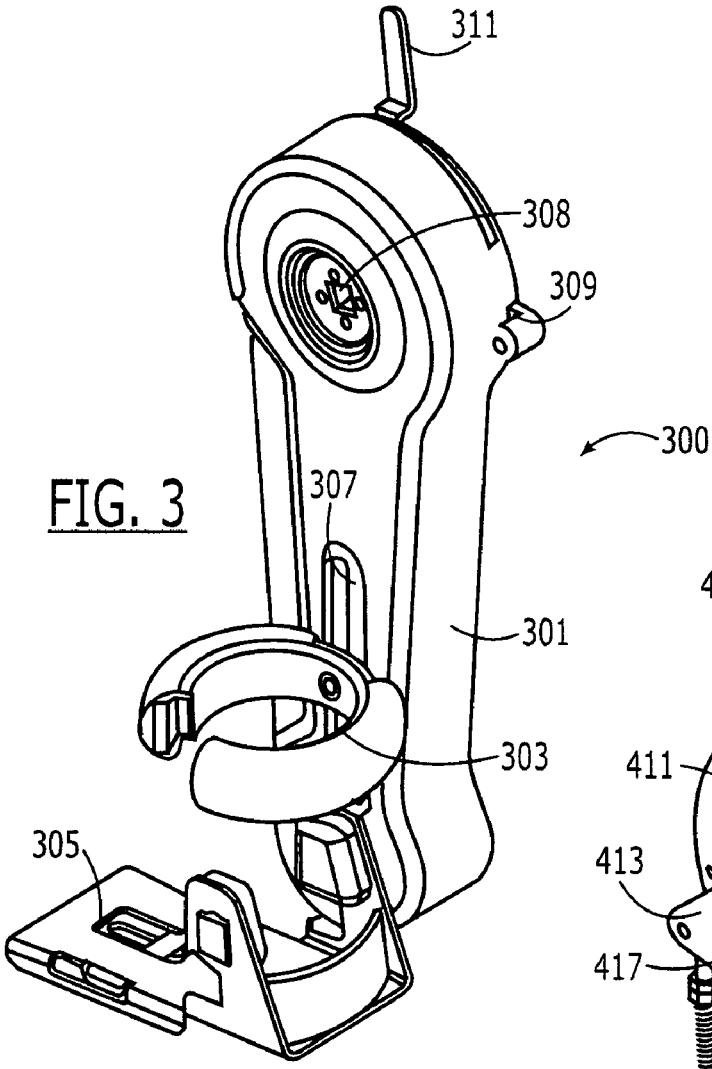
FIG. 3 is an embodiment of a lower extremity joint linkage device of the present invention.
Figure 4:
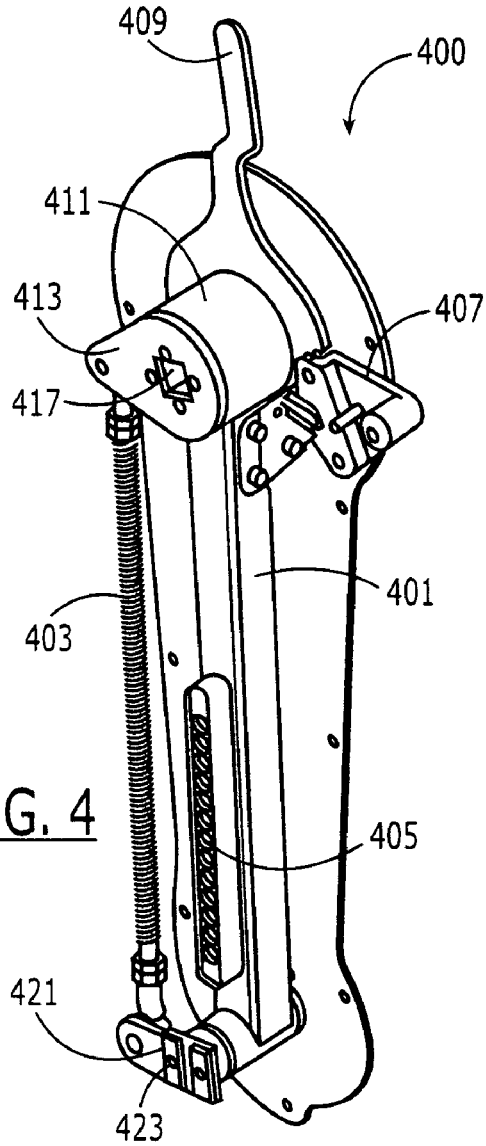
FIG. 4 shows the internal components of the lower extremity joint linkage device.

FIGS. 3 and 4 show the external and internal components of lower extremity device of the present invention.

FIG. 3 shows the external component of an embodiment of a lower extremity joint linkage device 300. The device 300 includes a body 301, a shank cuff 303, a foot rest 305, a knee brace 308, cuff adjustment means 307, a switch mechanism 309, and an extended bar 311.

The body 301, as in the lower extremity joint linkage device, can be a light weight metal or a polymer/plastic material. Preferably, the body 301 is plastic.

The shank cuff 303 can be a bracelet design with a closeable clasp on the cuff. In other embodiments, the shank cuff 303 can be any attachment device suitable for holding the leg shank in position, for example Velcro strap, chain, etc. The position of the shank cuff 303 can be adjusted by the cuff adjustment means 307, such as various holes into which the shank cuff 303 can be inserted into. The cuff adjustment means 307 can extend the full length of the device 300.

The foot rest 305 is used for resting the foot of the user. The foot rest is also capable of providing training to the ankle joint of the user. The foot rest 305 is adjustable to accept a variety of foot sizes.

A switch mechanism 309 is included to allow toggling between training the knee joint, ankle joint, or hip joint of the user. The switch mechanism 309 activates a pawl for insertion into a particular ratchet. Like the upper extremity device, the switch mechanism 309 may be manually or electronically operable. Operation includes the switch 309 operating in a joint.

A knee brace 308 is used for providing support to the outside of the user's knee. This is to ensure that, when being trained, the user's limb is focused on vertical movement as opposed to horizontal movement.

The range of movement of the device is limited by an extended bar 311. The extended bar 311 limits movement by contacting blocks positioned on a surface. The blocks can be from 10° to 270° apart.

FIG. 4 shows the internal components of an embodiment of a lower extremity device 400 of the present invention.

The components of the device 400 includes an upper plate 413, a middle plate 411, and a distal plate 421, wherein the upper plate 413 and distal plate 421 are connected with a side bar 403 and main bar 401.

The upper plate 413 is used for accepting a shaft from a motor device, such device being used to aid during training. The upper plate 413 includes an extended portion for contacting with the side bar 403, and a hole 415 to accept the shaft.

The side bar 403 extends from the upper plate 413 to the distal plate 421. The side bar 403 can be made of a metal, such as stainless steel, or a polymer such as hard plastic. The side bar 403 can have a male end for connecting to female ends such as a nut 417, such female ends being on both the upper plate 413 and the distal plate 421.

The distal plate 421 is positioned adjacent to an adaptor 423 for accepting the foot rest (not shown). The distal plate 421 connects to the upper plate 413, and is actuated by the upper plate 413 when torque is applied by a motor. The adaptor 423 is activated when the distal plate 421 is rotated, leading to rotation of the foot rest.

A main bar 401 is rotatably positioned between the middle plate 411 and the foot rest adapter 423. The main bar 401 is allowed to rotate through the use of ball bearings. The main bar 401 further includes a shank cuff adjustment means 405, such as holes, for positioning the shank cuff.

As stated previously, the device 400 includes a switch mechanism 407 and extended bar 409.

Figure 5:
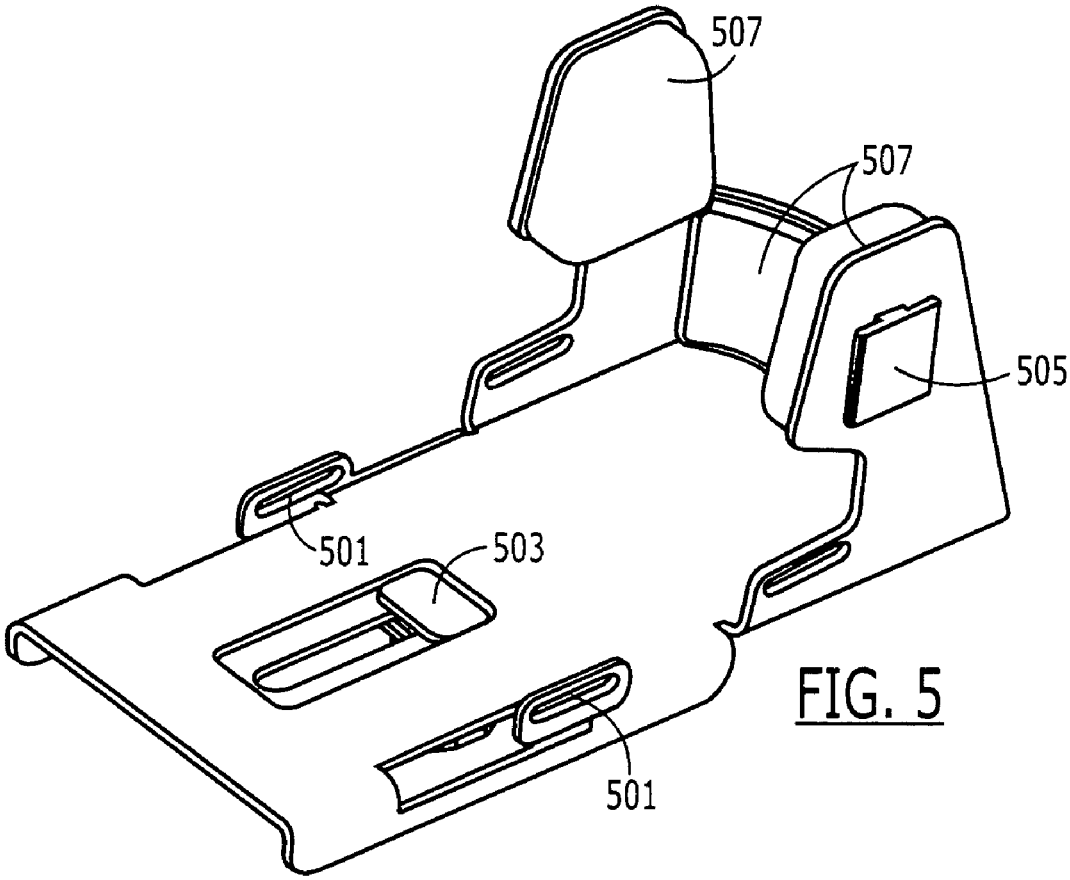
FIG. 5 shows an embodiment of the foot rest device to be attached to the lower extremity joint linkage device (top side).
Figure 6:
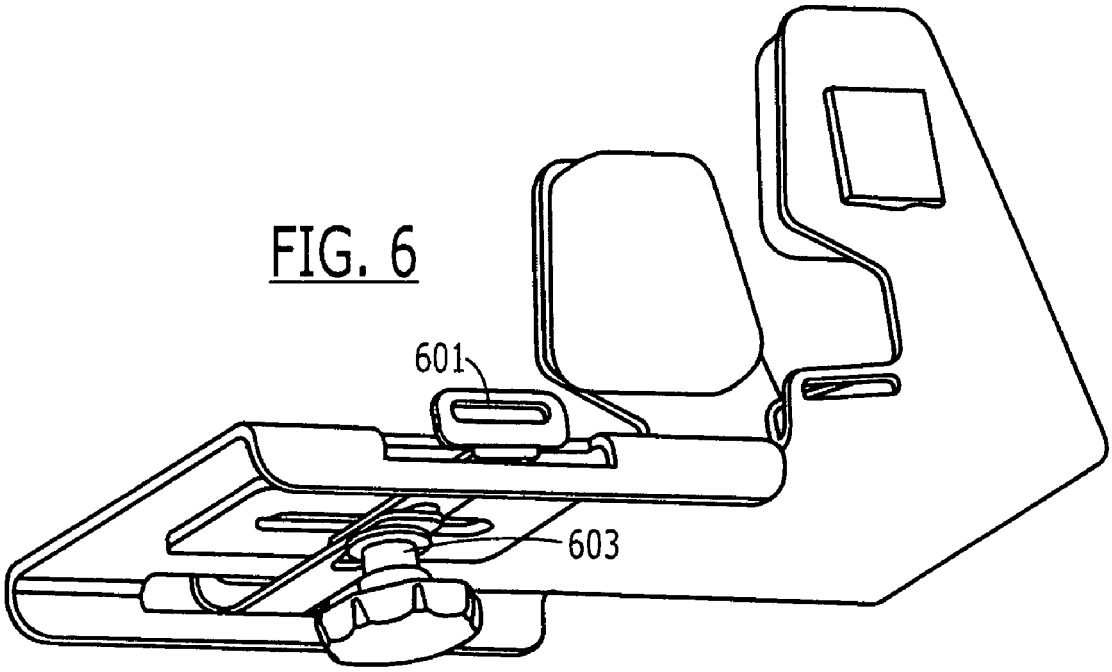
FIG. 6 shows the bottom side of foot rest device.

FIGS. 5 and 6 show the foot rest to be used with a lower extremity device of the present invention.

FIG. 5 exhibits a foot rest embodiment 500 having strap holders 501, an adjustable knob 503, an adapter connector 505 to connect to the joint linkage device, and pods 507 for accommodating a user's foot.

FIG. 6 shows the bottom side of the foot rest, including the strap holders 601 and the adjustable knob 603.

Figure 7:
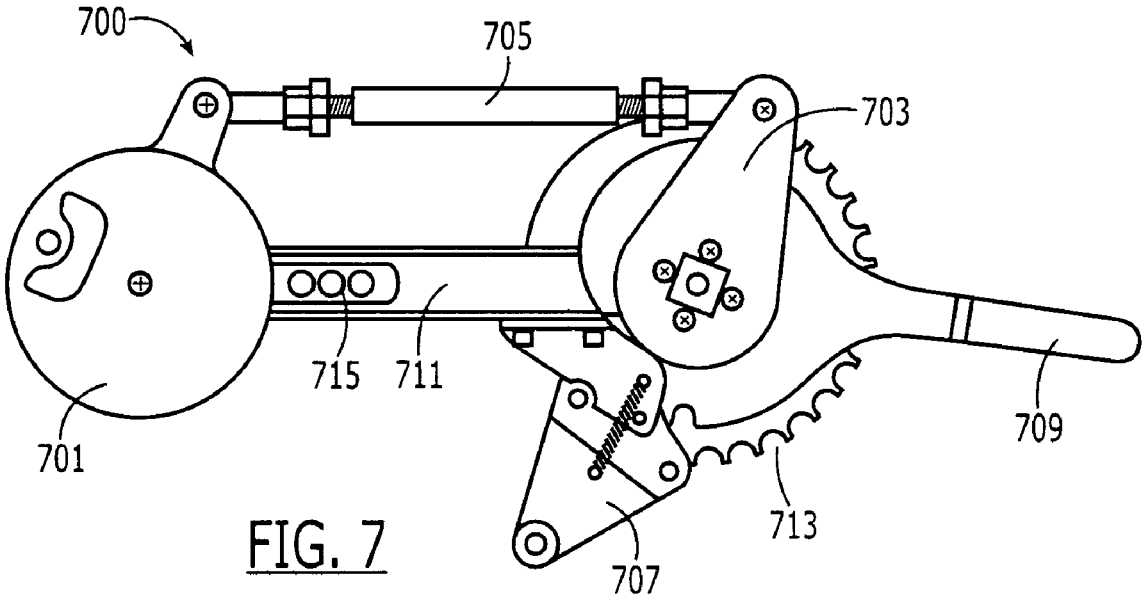
FIG. 7 shows the topside view of the internal components of the upper extremity joint linkage device.

FIG. 7 is a top side view of an upper extremity joint linkage device, including but not limited to a distal plate 701, an upper plate 703, a side bar 705, a switch mechanism 707, a lower plate with ratchets 713, an extended bar 709, a main bar 711, and arm cuff adjustment means 715. The lower plate with ratchets 713 is suitable for accepting the switching mechanism 707 and locking it in place via the pawl (not shown). Holes on the lower plate 713 can accept a connector on the switch mechanism 707 to allow different proximal joint angles during the rotation training on the distal joint. In one embodiment, the holes are 10 degrees apart, which means the joint angle can adjust by 10 degrees each time.

Figure 8:
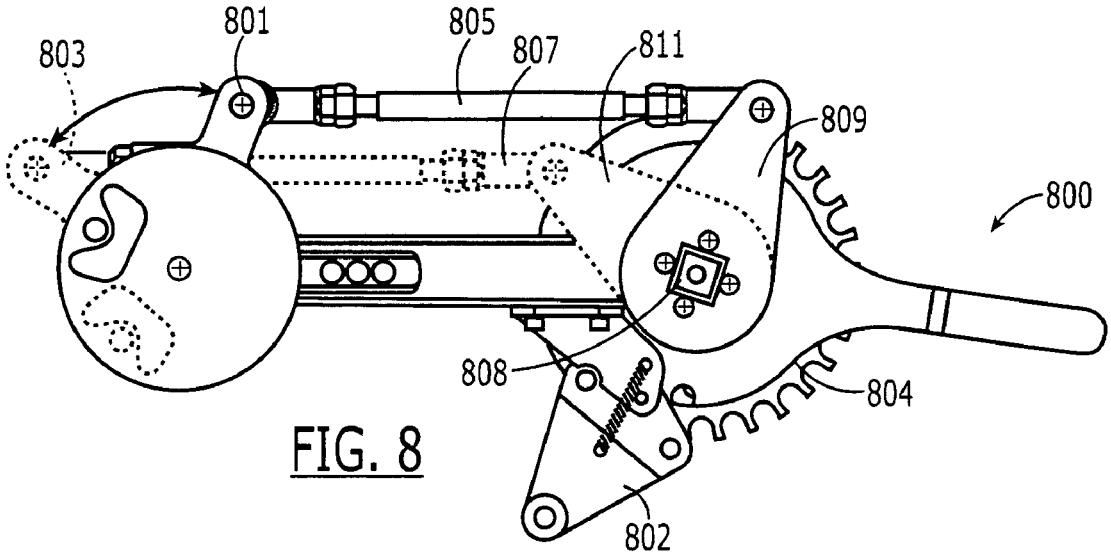
FIG. 8 shows the method of rotation capability of the upper extremity joint, rotation being at the distal end.

FIG. 8 is a method of rotating a distal plate of a joint linkage device.

In training, torque is applied to the device 800 by a motor attached to the upper plate 809 specifically through a hole in the upper plate 808. Firstly, the switch mechanism 802 is locked in place along the lower plate with ratchets 804. As stated, the switch mechanism 802 has a pawl for interacting with the lower plate. The upper plate in a first position 809 is moved by the user, aided or resisted by a torque rotating the device 800. Movement of the upper plate to a second position 811 causes the side bar in a first position 805 to move to a second position 807. The movement of the side bar causes the distal plate to move from a first position 801 to a second position 803. In this embodiment, when the switch mechanism 802 is locked thusly, the rotation of the distal plate 801/803 allows a distal joint of the user, for example the wrist joint or ankle joint, to be rotated.

Figure 9:
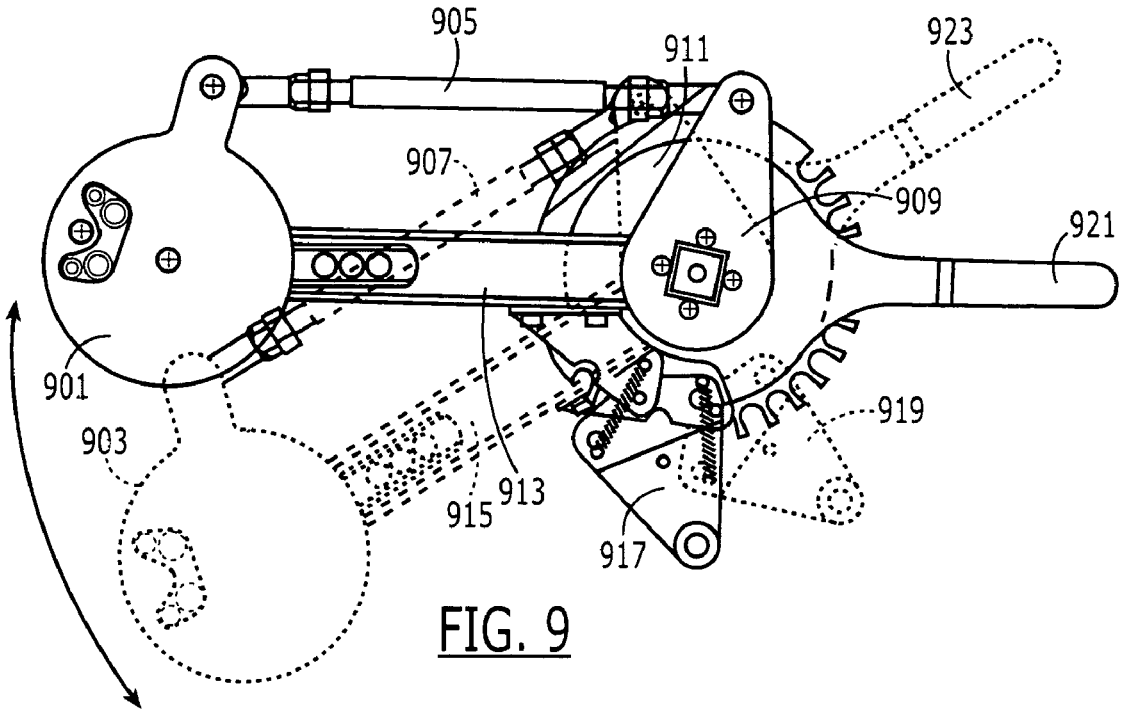
FIG. 9 shows the method of training a proximal joint of a user, with rotation being at the proximal end.

FIG. 9 is a method of rotating a proximal plate of a joint linkage device. In this method, the switch mechanism is locked in a position such that the distal plate does not rotate, but the main bar is allowed to rotate.

Firstly, the switch mechanism is locked the upper plate and middle plate. In use, a torque is applied to the upper plate via a motor. Upon application, the upper plate moves from a first position 909 to a second position 911. The side bar moves from a first position 905 to a second position 907. Simultaneously, the main bar is rotates along the middle plate (not shown), from a first 913 to a second position 915. The distal plate does not rotate position in response to the main bar, from a first position 901 to a second position 903.

Figure 10:
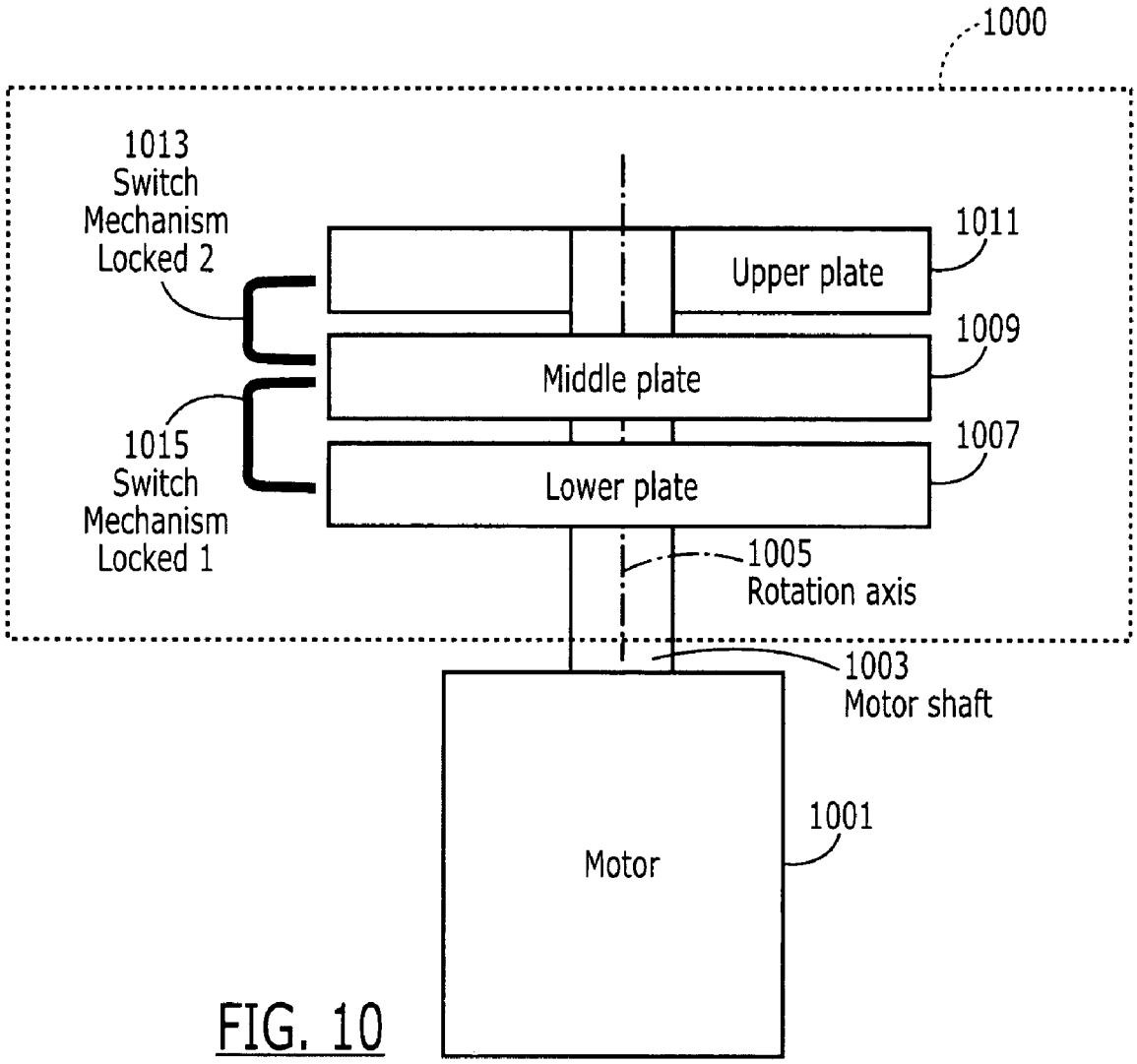
FIG. 10 shows the method of movement when the switch mechanism of the invention is in locked 1 or locked 2.

FIG. 10 exhibits the means by which the joint linkage device is capable of rotating both a distal and a proximal plate.

As stated earlier a motor 1001 provides torque to the training device 1000 via a motor shaft 1003. The motor shaft connects directly to an upper plate of the device 1000. The upper plate 1011 is connected to the distal plate (not shown) to generate distal joint rotation if the middle plate 1009 is not locked with the upper plate 1011. The lower plate 1007 is permanently locked in place.

In use, if the switch mechanism is locked in position 1 1015, the middle plate 1009 and lower plate 1007 are locked together. The upper plate 1011 then rotates with the motor 1001, and the middle plate 1009 and the lower plate 1007 are locked in position. The device is now able to rotate a distal plate.

In another method, the switch mechanism is locked in position 2 1013. This position locks the middle plate 1009 with the upper plate 1011. The middle 1009 and upper 1011 plates are able to rotate together with the motor, while the lower plate 1007 is fixed. Such a method is able to generate rotation in a proximal plate of the device.

FIG. 11 is an embodiment of the switch mechanism and plates of the training device. The switching mechanism 1101, through its handle, is able to contact one of two positions, specifically a first hole 1103 or a second hole 1107. An additional pawl 1105 on the switch mechanism 1101 allows the second lock 1107 to be contacted. In a first hole 1103, the lower plate 1109 via ratchets 1115, is locked along with the middle plate 1111. In the second hole 1107, the middle plate 1111 is locked with the upper plate 1113.

FIG. 12 is an embodiment of a user interacting with the present joint linkage device.

The user's 1201 limb 1203 is positioned through the arm cuff 1207 of the device 1205. The user's hand 1209 is set into the hand clasps. As shown, the device 1205 is locked into a position where the distal plate is allowed rotate, thus allowing the wrist joint of the user 1201 to rotate.

The device 1205 is mounted on a robotic system 1211.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A joint linkage device for training multiple joints in a limb, comprising an upper plate having an extended portion;

a middle plate positioned underneath said upper plate;

a lower plate positioned underneath said middle plate having a switch mechanism attached thereto;

a distal plate having an extended portion;

a side bar rotatably positioned between both of said extended portions;

a main arm rotatably positioned between said middle plate and the base of said distal plate;

a cuff;

a clasp selected from group consisting of a foot rest and a hand clasp;

and extended bar for contacting stoppage blocks, wherein said lower plate includes ratchets on its perimeter for contacting a pawl actuated by said switch mechanism.

2. The joint linkage device in claim 1, further comprising a cuff adjustment means.

3. The joint linkage device in claim 1, further comprising an adaptor adjacent to said distal plate.

4. The joint linkage device in claim 3, wherein said clasp is attached to said adaptor.

5. The joint linkage device in claim 1, wherein said side bar comprises threaded ends on both ends.

6. The joint linkage device in claim 5, wherein said extended portions of said upper plate and distal plate have female ends for accepting said threaded ends of said side bar.

7. The joint linkage device in claim 1, wherein said clasp is rotatably positioned on said distal plate.

8. The joint linkage device in claim 1, wherein said upper plate further comprises a hole to accept a motor shaft.

9. The joint linkage device in claim 1, further comprising electronic components for making the device electronically operable.

10. The joint linkage device in claim 1, further comprising a body.

11. A method of rotating a distal plate of a joint linkage device, comprising the steps of locking a middle plate and a lower plate;

applying a torque to an upper plate;

rotating said upper plate from a first position to a second position, while simultaneously rotating a side bar from a first position to a second position;

and rotating said distal plate from a first position to a second position.

12. The method of rotating a distal plate in claim 11, wherein locking said middle plate and said lower plate occurs by actuating a switch mechanism to contact a pawl with ratchets on said lower plate.

13. The method of rotating a distal plate in claim 11, wherein applying a torque is selected from the group consisting of an assistance torque, a resistance torque, and a assistance/resistance torque.

14. The method of rotating a distal plate of a joint linkage device in claim 11 further comprising the step of leaving stationary main bar between a proximal part and distal part of said joint linkage device.

15. A method of rotating a proximal plate of a joint linkage device comprising the steps of:

locking an upper plate and a middle plate;

applying a torque to said upper plate;

rotating said upper plate from a first position to a second position;

rotating a side bar from a first position to a second position;

rotating a main bar from a first position to a second position;

and moving a distal plate from a first position to a second position, wherein said distal plate does not rotate.

16. The method of rotating a proximal plate of a joint linkage device in claim 15, wherein applying a torque is selected from the group consisting of an assistance torque, a resistance torque, and a assistance/resistance torque.

17. The method of rotating a proximal plate of a joint linkage device in claim 16, wherein locking said upper plate and middle plate occurs by actuating a switch mechanism.

* * * * *